United States Patent [19]

Dreyfuss et al.

[11] 4,438,783

[45] Mar. 27, 1984

[54] PROTECTIVE DEVICE FOR PIPES

[75] Inventors: Wilfried Dreyfuss, Dorfstrasse 52, D-3111 Eimke, Fed. Rep. of Germany; Thomas E. Remp, Jr., 5555 Del Monte Dr. T-Z, Houston, Tex. 77056; Kurt Müller, Eicklingen, Fed. Rep. of Germany

[73] Assignees: Wilfried Dreyfuss, Fed. Rep. of Germany; Thomas E. Remp, Houston, Tex.

[21] Appl. No.: 366,981

[22] Filed: Apr. 9, 1982

[30] Foreign Application Priority Data

Apr. 9, 1981 [DE] Fed. Rep. of Germany ..... 3114368
Apr. 9, 1981 [DE] Fed. Rep. of Germany ..... 3114264

[51] Int. Cl.[3] ..... F16L 55/24

[52] U.S. Cl. ..... 138/89; 138/91; 138/96 T; 138/104; 73/335; 116/67 R

[58] Field of Search ..... 138/89, 91, 96 R, 96 T, 138/104, 108, 178, DIG. 6; 73/335, 76; 116/206, 67 R

[56] References Cited

U.S. PATENT DOCUMENTS

| | | | |
|---|---|---|---|
| 1,705,837 | 3/1929 | Rowan | 116/67 R |
| 2,716,338 | 8/1955 | Blinn | 73/33 S |
| 2,737,205 | 3/1967 | Stringfield | 138/89 |
| 2,826,222 | 3/1958 | Case | 138/96 T |
| 2,977,993 | 4/1961 | Scherer | 138/96 T |
| 3,052,083 | 9/1962 | Piquerez | 73/335 |
| 3,085,424 | 4/1963 | Berg | 73/335 |
| 3,246,758 | 4/1966 | Wagner | 116/206 |
| 3,260,234 | 7/1966 | Serrano et al. | 116/206 |

*Primary Examiner*—John W. Shepperd
*Attorney, Agent, or Firm*—Allegretti, Newitt, Witcoff & McAndrews, Ltd.

[57] ABSTRACT

A device that protects the inner surface of pipes from rust is disclosed. This device is especially useful for pipes provided with threading and a thread guard at their threaded ends to form an airtight seal. The device comprises a holder that can be inserted in the pipes on which a number of receptacles are attached at intervals. The receptacles are filled with a drying agent or dessicant and are made of a moisture permeable material. A moisture indicator may be placed in the base of the thread guard.

14 Claims, 7 Drawing Figures

PROTECTIVE DEVICE FOR PIPES

BACKGROUND OF THE INVENTION

1. Field of the Invention

The present invention concerns protective devices for pipes that have threading.

2. Background of the Invention

Pipes, particularly pipes for oil fields, are often exposed to various climatic conditions when transported and stored. As a result pipes tend to corrode, primarily on their inside. Usually pipes with threading are provided with protective caps to protect the threads. Also, in order to prevent foreign bodies and rain water from reaching the interior of the pipes, closed or sealed protective caps and protective plugs are often used. But these caps and plugs result in the formation of condensed water due to variations in temperature. This water enhances the formation of rust.

Chemical agents that absorb moisture from their surroundings are well known in the prior art. Such agents are generally known as dessicants or drying agents. It is also known that in order to protect pipes from rust, dessicants may be packed in bags and inserted just inside the ends of pipes. These known protective devices do not suffice to protect pipes from the formation of rust, however. The moisture in pipes, particularly those of considerable length, is only absorbed by the dessicant that is in the immediate vicinity of the moisture. Thus, the inner pipe surfaces may rust despite the dessicant at the ends of the pipe. Thus with prior protective devices it is necessary to inspect the pipes from time to time by removing the protective caps and protective plugs. This visual inspection is quite cumbersome, time-consuming, and expensive.

SUMMARY OF THE INVENTION

It is an object of the present invention to provide a protective device that prevents corrosion, particularly rusting, of the inner walls of pipes.

It is a further object of the present invention to provide a device that prevents the corrosion of inner pipe walls that can be inspected quickly and easily.

It is a specific object of the present invention to provide a simple way to introduce dessicants precisely into pipes so that a safeguard against moisture and rust is insured along the entire length of the pipe. The dessicant may be distributed in portions or packed in receptacles along the interior of the pipe at regular or irregular intervals. A continuous distribution along the interior of the pipe is also possible. Moreover, it is possible to fasten the present invention to pipes without any special tools or expertise.

It is an additional object of the present invention to provide a protective device for pipes that can remain in place once it is inserted in the pipe. The interior of the pipe can be inspected by monitoring the moisture with the help of a suitable moisture indicator. A measuring and warning device can also be used that will emit an optical or acoustical warning signal when a predetermined degree of moisture is reached. Because of the design of this invention, the exacting and expensive removal of the protective device for inspection is obviated. The moisture indicator can determine immediately whether there is enough moisture present in the interior of the pipe to permit the formation of rust.

Further objects of the present invention will become evident from the following description of the preferred embodiments and claims.

DESCRIPTION OF THE PREFERRED EMBODIMENTS

Figure 1:
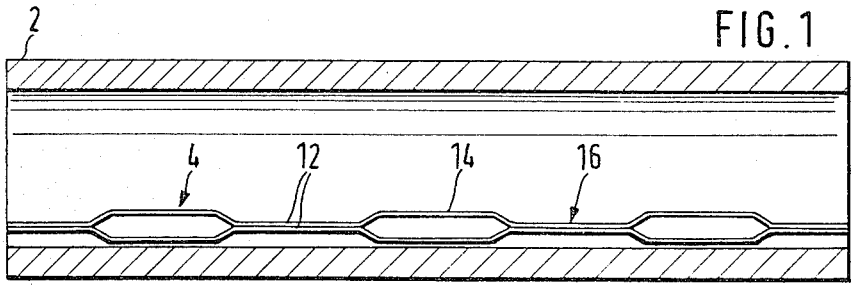
FIGS. 1 through 5 show various embodiments of the protective device of the present invention and their placement in a cross-section of pipe.

A pipe is identified in FIGS. 1 to 5 with the reference number 2, in which rust guards 4, 6, 8, 10 and 25 have been placed. The rust guard 4 shown in FIG. 1 has a two-layer strip 12, in which cushions 14 between which there are recesses 16. Dessicant is placed in the cushions 14.

Figure 2:
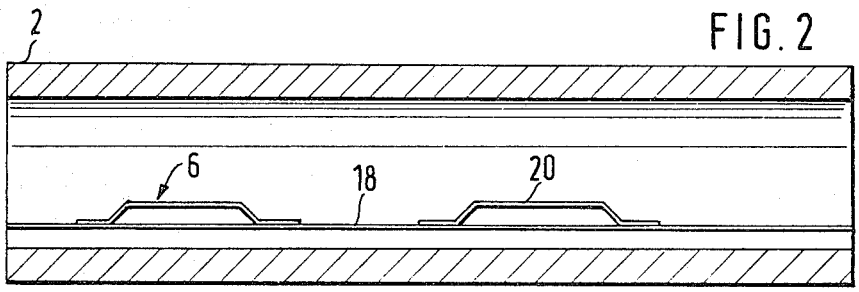

The rust guard 6 shown in FIG. 2 has a single-layer strip 18 on which cushions 20 are attached at specific intervals. The cushions may be attached by sewing, gluing or any other suitable means. Dessicant is present in the cushions 20.

Figure 3:
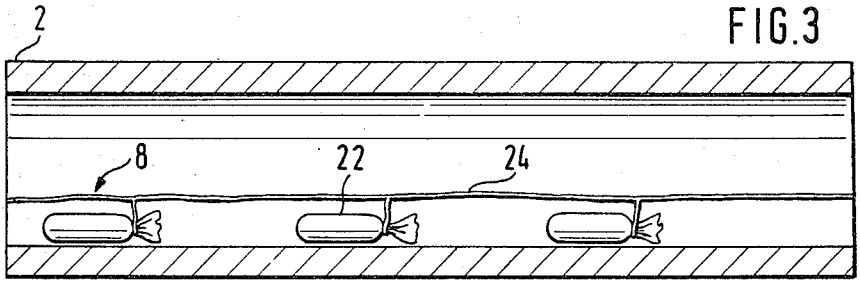

The rust guard shown in FIG. 3 consists of bags 22 filled with dessicant that are attached at intervals to a tape or a rope 24, for example, by tying or clamping.

Figure 4:
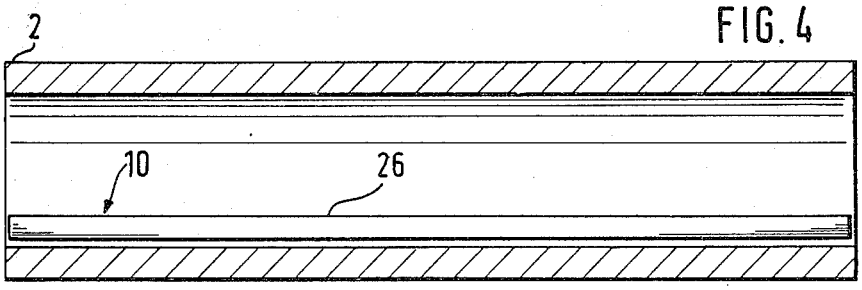

The rust guard 10 shown in FIG. 4 has a hose 26 filled with a dessicant with its ends sealed.

Figure 5:
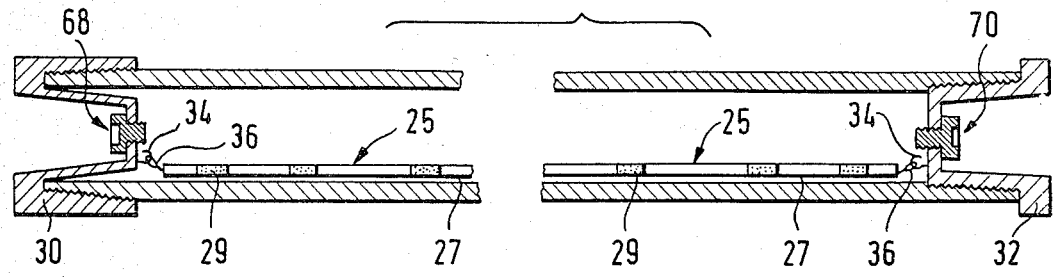

The rust guard 25 shown in FIG. 5 has a strip of nonwoven fabric 27. The dessicant is sewed into the fabric in the form of tablets 29.

The cushions 14 and 20 and the bags 22 as well as the tablets 29 can be placed at regular or irregular intervals.

In all of the above examples, a material permeable to moisture, such as nonwoven fabric, is used to make the cushions, bags and the hose.

Preferably, the rust guards 4, 6, 8, 10 and 25 are fastened to the ends of the pipe (not shown in FIGS. 1–4). They can be attached, as shown in FIG. 5, by means of protective caps 30 or protective plugs 32. These caps or plugs usually seal the ends of the pipe with the help of hoods 34 attached to the caps and eyelets 36 mounted on the rust guards 25 or by use of suitable clamping devices.

For pipes with larger diameters, it is preferable to place a number of the rust guards adjacent to each other within such pipes.

Figure 6:
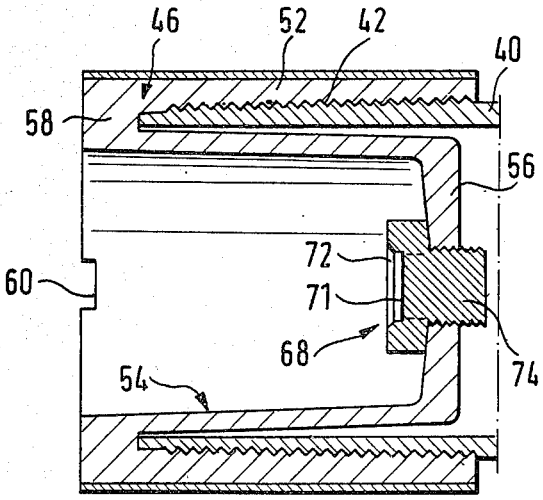
FIGS. 6 and 7 show moisture indicator arrangements according to the present invention in a cross-section of pipe.
Figure 7:
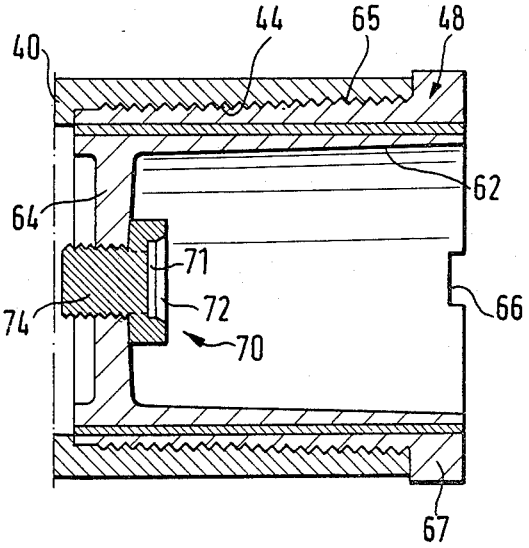

FIG. 6 shows a pipe 40 that has at one end an outer thread 42 and at the other end an inner thread 44. A protective cap 46 is screwed onto the outer thread and a protective plug 48 onto the inner thread.

The protective cap 46 has a casing 52 provided with an inner thread 50 and a cup-shaped insert 54 with a base 56. The insert 54 is connected to the casing 52 by way of a ring-shaped stay section 58 that covers the edge of the pipe. The stay section 58 has grooves 60 that provide a working surface for tools.

The protective plug 48 is constructed in the shape of a cupshaped insert with a casing 62 and a base 64. The casing 62 has an outer thread 65. A ring flange 64, in which grooves 66 are provided for contact with a tool, covers the edge of the pipe.

A moisture indicator 68 or 70 may be placed either in the base 56 of the protective cap or in the base 64 of the protective plug. Normally, one such moisture indicator is sufficient.

The moisture indicator 71 can indicate different moisture ranges by means of color changes. It may be placed in a viewing glass 72 of a thread plug 74 that is screwed into the base of the protective device. The moisture indicator 71 should be mounted so that it can be easily inspected or replaced. The moisture indicator can also be an electric moisture meter or hygrometer to which a warning device is connected. This warning device can either acoustically or visually indicate whether a specific moisture content necessary for corrosion has been reached.

The protective cap 46 and the protective plug 48 may also have bases that are generally coplanar with the stay section 58 or the ring flange 67.

It is to be understood that the above described embodiments of the invention are merely illustrative of applications of the principles of the invention and that numerous other arrangements and modifications may be made within the spirit and scope of this invention.

We claim as our invention:

1. A protective device for a longitudinal pipe having an interior comprising thread guards at the ends of the pipe, a rust guard and a moisture indicator, said rust guard being a dessicant substantially evenly distributed throughout said interior of said longitudinal pipe such that corrosion of said interior is prevented.

2. The protective device of claim 1 wherein said rust guard comprises a receptacle containing dessicant attached to at least one support means.

3. The protective device of claim 2 wherein said receptacle comprises a bag, cushion, packet, or tablet.

4. The protective device of claim 2 wherein said support means comprises a tape, rope, cord, strap or rod.

5. The protective device of claim 2 wherein said receptacle is attached to said support means by tying, clamping, gluing, taping, sewing or welding.

6. The protective device of claim 2 wherein said receptacle and said support means both comprise a hose.

7. The protective device of claim 2 wherein said support means is attached to both ends of said pipe.

8. The protective device of claim 1 wherein said thread guard is mounted on one end of said pipe such that an airtight seal is formed.

9. The protective device of claim 8 wherein said thread guard comprises a base and a casing, said casing having threads.

10. The protective device of claim 9 wherein said moisture indicator is attached to said base of said thread guard.

11. The protective device of claim 8 wherein said moisture indicator is located within said pipe in said airtight seal.

12. The protective device of claim 11 wherein said moisture indicator is mounted in a threaded plug having a viewing glass such that said moisture indicator is visible through said viewing glass.

13. The protective device of claim 1 wherein said rust guard is placed inside said pipe.

14. The protective device of claim 1 wherein said moisture indicator comprises a hygrometer and a warning device, said warning device being connected to said hygrometer such that said warning device is activated at a certain moisture level.

* * * * *